US010774800B2

(12) United States Patent
Agresta et al.

(10) Patent No.: US 10,774,800 B2
(45) Date of Patent: Sep. 15, 2020

(54) NOZZLE BODY AND FUEL INJECTION VALVE

(71) Applicant: Continental Automotive GmbH, Hannover (DE)

(72) Inventors: Antonio Agresta, Pisa (IT); Luca Gestri, Cascina (IT); Eberhard Kull, Regensburg (DE); Marco Saliu, Sassari (IT); Hong Zhang, Tegernheim (DE); Gerd Roesel, Regensburg (DE); Erwin Achleitner, Obertraubling (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 315 days.

(21) Appl. No.: 15/103,976

(22) PCT Filed: Dec. 3, 2014

(86) PCT No.: PCT/EP2014/076384
§ 371 (c)(1),
(2) Date: Jun. 13, 2016

(87) PCT Pub. No.: WO2015/086392
PCT Pub. Date: Jun. 18, 2015

(65) Prior Publication Data

US 2016/0319792 A1 Nov. 3, 2016

(30) Foreign Application Priority Data

Dec. 11, 2013 (EP) ..... 13196572

(51) Int. Cl.
*F02M 61/18* (2006.01)

(52) U.S. Cl.
CPC ..... *F02M 61/1833* (2013.01); *F02M 61/188* (2013.01); *F02M 61/1846* (2013.01); *F02M 2200/06* (2013.01)

(58) Field of Classification Search
CPC ..... F02M 61/1833; F02M 61/1846; F02M 61/188; F02M 2200/06
(Continued)

(56) References Cited

U.S. PATENT DOCUMENTS 4,069,978 A * 1/1978 El Moussa ..... F02M 61/1806 219/121.13
4,360,161 A * 11/1982 Claxton ..... B05B 1/3405 239/463
(Continued)

FOREIGN PATENT DOCUMENTS

DE 4104019 C1 4/1992 ..... B05B 1/04
DE 19925380 A1 12/2000 ..... F02M 61/18
(Continued)

OTHER PUBLICATIONS

Korean Office Action, Application No. 2017005530007, 10 pages, dated Jan. 23, 2017.
(Continued)

*Primary Examiner* — Tuongminh N Pham
(74) *Attorney, Agent, or Firm* — Slayden Grubert Beard PLLC

(57) ABSTRACT

The present disclosure relates to a nozzle body for a fuel injection valve, the nozzle body including a cavity and an injection channel for dispensing fuel from the cavity. The injection channel includes a first section and a second section downstream of the first section, the first and second sections having a common interface. The first section extends from a fuel inlet opening to a second opening disposed at the common interface. The cross-sectional area of the first section monotonically decreases from the fuel inlet opening to the common interface. The cross-sectional area of the second section monotonically increases from the common interface to the fuel outlet opening.

10 Claims, 1 Drawing Sheet

(58) Field of Classification Search
USPC ..... 239/533.2, 533.14, 596, 597–601
See application file for complete search history.

(56) References Cited

U.S. PATENT DOCUMENTS

| | | | | |
|---|---|---|---|---|
| 5,244,154 | A | 9/1993 | Buchholz et al. | 239/590.3 |
| 6,520,145 | B2 | 2/2003 | Hunkert | 123/305 |
| 6,644,565 | B2 * | 11/2003 | Hockenberger | F02M 61/1806 239/533.12 |
| 8,191,800 | B2 | 6/2012 | Kitagawa et al. | 239/533.12 |
| 8,237,083 | B2 * | 8/2012 | Walter | B23K 26/0054 219/121.71 |
| 2002/0158152 | A1 | 10/2002 | Hockenberger | 239/533.12 |
| 2004/0104285 | A1 * | 6/2004 | Okamoto | F02M 51/0671 239/533.12 |
| 2008/0105767 | A1 * | 5/2008 | Fujii | F02M 45/08 239/533.2 |
| 2009/0272824 | A1 | 11/2009 | Kitagawa et al. | 239/585.5 |
| 2015/0034053 | A1 | 2/2015 | Maier et al. | 123/490 |

FOREIGN PATENT DOCUMENTS

| | | | | |
|---|---|---|---|---|
| DE | 10214096 | A1 | 10/2002 | F02M 47/02 |
| DE | 10354467 | A1 | 6/2005 | F02M 51/06 |
| DE | 102007000701 | A1 | 4/2008 | F02M 61/04 |
| DE | 102011089240 | A1 | 6/2013 | F02M 61/10 |
| DE | 102011089512 | A1 | 6/2013 | F02M 61/18 |
| EP | 1840368 | A2 | 10/2007 | B23H 7/26 |
| JP | 5965562 | A | 4/1984 | F02M 61/18 |
| JP | 2003120472 | A | 4/2003 | F02M 61/18 |
| JP | 4610631 | B2 | 1/2011 | F02M 51/06 |
| KR | 100627745 | B1 | 9/2006 | F02M 61/18 |
| WO | 2015/086392 | A1 | 6/2015 | G02M 61/18 |

OTHER PUBLICATIONS

Extended European Search Report, Application No. 13196572.5, 6 pages, dated Apr. 4, 2014.

International Search Report and Written Opinion, Application No. PCT/EP2014/076384, 10 pages, dated Jan. 13, 2015.

Korean Notice of Allowance, Application No. 2017049784848, 4 pages, dated Jul. 18, 2017.

Chinese Office Action, Application No. 201480067346.1, 14 pages, dated Oct. 26, 2017.

* cited by examiner

NOZZLE BODY AND FUEL INJECTION VALVE

CROSS-REFERENCE TO RELATED APPLICATIONS

This application is a U.S. National Stage Application of International Application No. PCT/EP2014/076384 filed Dec. 3, 2014, which designates the United States of America, and claims priority to EP Application No. 13196572.5 filed Dec. 11, 2013, the contents of which are hereby incorporated by reference in their entirety.

TECHNICAL FIELD

The present disclosure relates to internal combustion engines in general and describes a nozzle body for a fuel injection valve and a fuel injection valve.

BACKGROUND

Fuel injection valves are used for dosing fuel into intake manifolds of internal combustion engines or directly into combustion chambers of internal combustion engines. When fuel is dosed directly into a combustion chamber of an internal combustion engine, a tip of the nozzle body of the fuel injection valve may protrude into the combustion chamber. There, it is exposed to the combustion process which may lead to soot collecting on the injector tip.

Increasingly strict emission standards include particle number limits for gasoline engine emission. Tip sooting can be problematic in this respect since it increases the emission of particles. This is because carbon layers on the tip are operable to store a portion of the fuel dispensed from the injection valve. The stored fuel may lead to a so-called fat combustion or rich combustion which is a source of soot particles.

SUMMARY

The teachings of the present disclosure enable a nozzle body for a fuel injection valve having a particularly low risk for tip sooting.

In some embodiments, a nozzle body (10) for a fuel injection valve (1) may include a cavity (15) and an injection channel (20) for dispensing fuel from the cavity (15). The injection channel (20) has a first section (22) and a second section (24), downstream of the first section (22), the first and second sections (22, 24) having a common interface (26). The first section (22) extends from an fuel inlet opening (221) to a second opening (222) which is comprised by the common interface (26). The cross-sectional area of the first section (22) is monotonically decreasing in the course from the fuel inlet opening (221) to the common interface (26). The second section (24) extends from a bottom surface (241) which is comprised by the common interface (26) and perforated by the second opening (222) to a fuel outlet opening (242). The cross-sectional area of the second section (24) is monotonically increasing in the course from the common interface (26) to the fuel outlet opening (242).

In some embodiments, the first section (22) has the shape of a truncated cone tapering in the course from the fuel inlet opening (221) to the second opening (222).

In some embodiments, the first section (22) has a side surface (223) having an inclination angle ($\alpha$) between 0.3° and 6° with respect to a central axis (A) of the truncated cone shape of the first section (22), the limits being included.

In some embodiments, the second section (24) has the shape of a truncated cone widening in the course from the bottom surface (241) to the fuel outlet opening (242).

In some embodiments, the first section (22), by means of its cross-sectional area decreasing monotonically in the course from the fuel inlet opening (221) to the common interface (26), is operable to form a divergent fuel spray cone (28) emerging from the second opening (222), the fuel spray cone (28) having a predetermined cone angle ($\sigma$), and wherein the second section (24) has a side surface (243) having an inclination angle ($\beta$) which is at least as large as said cone angle ($\sigma$) and at most 6° larger than said cone angle ($\sigma$) with respect to a central axis (A) of the truncated cone shape of the second section (24).

In some embodiments, the bottom surface (241) extends circumferentially around the second opening (222).

In some embodiments, a lateral distance (D) of the second opening (222) from a side surface (243) of the second section is 50 μm or smaller.

A fuel injection valve (1) may comprise a nozzle body (10) as described above.

DETAILED DESCRIPTION

Figure 1:
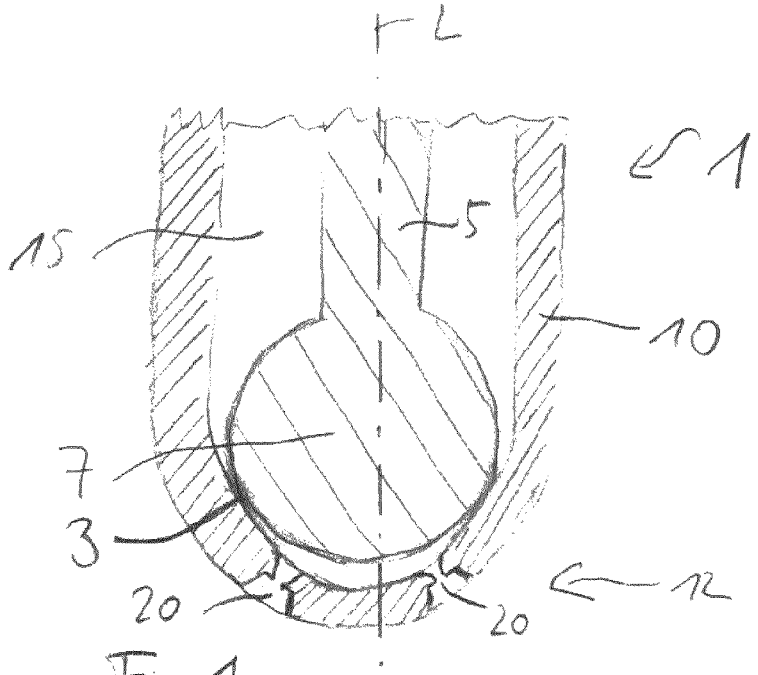
FIG. 1 shows a schematic longitudinal section view of a fuel injection valve with a nozzle body according to teachings of the present disclosure.

In some embodiments of the teachings of the present disclosure, the fuel injection valve is a gasoline injection valve.

The nozzle body has a cavity. The cavity extends in particular from a fuel inlet end to a fuel outlet end of the nozzle body. The fuel outlet end of the nozzle body represents an injector tip of the fuel injection valve. In some embodiments, it may be positioned in a combustion chamber of an internal combustion engine.

In some embodiments, the nozzle body comprises an injection channel for dispensing fuel from the cavity. A valve needle may be received in the cavity of the nozzle body. The valve needle is movable with respect to the nozzle body in reciprocating fashion. In a closing position, the valve needle is in contact with a valve seat-which may be comprised by the nozzle body-to prevent fluid flow through the injection channel. The valve needle is displaceable away from the valve seat for releasing fluid flow through the injection channel. In one embodiment, the valve seat and the injection channel may be comprised by a seat body of the nozzle body which is fixed to a base body of the nozzle body at the fuel outlet end, the seat body and the base body being separate parts.

In some embodiments, the injection channel has a first section and a second section, downstream of the first section, the first and second sections having a common interface. The first section extends from a fuel inlet opening to the common interface and the second section extends from the common interface to a fuel outlet opening. The cross-sectional area of the first section is monotonically decreasing in the course from the fuel inlet opening to the common interface. The cross-sectional area of the second section is monotonically increasing in the course from the common interface to the fuel outlet opening. The "cross-sectional area" is in particular understood to be the area content enclosed by a circumferential side surface of the respective section in a plane which is perpendicular to a central axis of the respective section. In some embodiments, the first and second sections share a common central axis which may be denoted as a channel axis of the injection channel.

In some embodiments, the first section extends from the fuel inlet opening to a second opening which is comprised by the common interface and the second section extends from a bottom surface which is comprised by the common interface and perforated by the second opening to the fuel outlet opening.

The first section—by means of its cross-sectional area decreasing monotonically in the course from the fuel inlet opening to the common interface—is operable to form a divergent fuel spray cone emerging from the common interface, in particular from second opening. The fuel spray cone has a predetermined cone angle. The cone angle may be the inclination angle of an imaginary circumferential envelope surface of the cone with respect to a central axis of the spray cone, i.e., the cone angle corresponds to the half opening angle of the cone. The envelope surface may, for example, be a conical surface.

Deposits on the side surface of the second section have a particularly high influence on the generation of soot particles. In some embodiments incorporating an injection channel taught by the present disclosure, the conically divergent shape of the spray cone corresponds to the conically divergent shape of the second section of the injection channel. In this way, the spray cone may interact with the injection channel over a particularly large portion of the second section for avoiding deposits on a side surface of the second section and/or for removing deposits from the side surface of the second section. For example, the spray is operable to clean the side surface of the second section by means of shear forces and droplet impact during the injection event.

In some embodiments, a reverse flow of particular high energy is achievable near the side surface of the second section by means of an injection channel according to the present disclosure. Zones of flow stagnation in the second section may be avoided or at least particularly small. In this way, the side surface of the second section may be kept clean over its complete length.

At the same time, with the separation of the injection channel into the convergent first section—which may also be called spray hole or flow hole—and the divergent second section—which may also be called step hole—particularly large lateral speeds of the fuel in the spray cone are achievable. In this way, the penetration depth of the spray cone can be kept particularly small as compared to injection channels without step hole. This may result in a low risk of wetting the combustion chamber with fuel from the spray dispensed by the nozzle body, which wetting could otherwise also lead to sooting. In addition, the spray may advantageously be atomized into particularly small droplets so that a combustion which generates a particularly small amount of particles is achievable.

In some embodiments, the second opening defines a break-away edge for the fluid flow. In particular, the fluid flow separates from the nozzle body at the break-away edge. Due to the presence of the second section of the injection channel downstream of the second opening, the risk of sooting on the surface of the nozzle body at its fuel outlet end outside of the injection channel is reduced.

In some embodiments, the first section is rotationally symmetric around a central axis, in particular around the channel axis. The first section may have the shape of a truncated cone tapering in the course from the fuel inlet opening to the common interface and/or to the second opening. The first section may have a side surface which is curved in a longitudinal section through a central axis of the first section. For example, in the shape of a hyperboloid. In some embodiments, the second section has the shape of a truncated cone which is widening in the course from the bottom surface to the fuel outlet opening. In this way, a good cleaning on all sides of the side surface of the second section is achievable.

In some embodiments, the first section has a circumferential side surface has an inclination angle between 0.3° and 6° with respect to the central axis of the truncated cone shape of the first section, the limits being included.

In some embodiments, the second section has a circumferential side surface having an inclination angle which is at least as large as the cone angle of the spray cone and at most 6° larger than said cone angle with respect to a central axis of the truncated cone shape of the second section, with respect to the channel axis. By means of the inclination angle of the second section being similar to the cone angle of the spray cone and at least as large as the cone angle, a good cleaning of the side surface of the second section is achievable over its full length.

In some embodiments, the bottom surface of the second section extends circumferentially around the second opening of the first section. For example, a lateral distance of the second opening from the side surface of the second section is 50 μm or smaller. The bottom surface may be in the shape of a circular ring having an inner contour defined by the second opening and an outer contour where the bottom surface merges with the side surface of the second section. The radius of the outer contour may be larger than the radius of the inner contour by 50 μm or less. In this way, the risk that zones of stagnating flow are present near the interface between the bottom surface and the side surface of the second section is low.

Further advantages, embodiments, and developments of the nozzle body and the fuel injection valve will become apparent from the exemplary embodiments which are described below in association with schematic figures.

In the exemplary embodiments and figures, similar, identical or similarly acting elements are provided with the same reference symbols. The figures are not regarded to be true to scale. Rather, individual elements in the figures may be exaggerated in size for better representability and/or better understanding.

FIG. 1 shows a schematic longitudinal section view of an example fuel injection valve 1 with a nozzle body 10 according to teachings of the present disclosure. The fuel injection valve is configured for dosing fuel, e.g., gasoline, into a combustion chamber of an internal combustion engine.

The nozzle body 10 has a cavity 15. The cavity 15 extends from a fuel inlet end (not shown in the figures) to a fuel outlet end 12 of the nozzle body 10 which represents an injector tip of the fuel injection valve 1. The fuel outlet end 12 is positioned in the combustion chamber of the internal combustion engine.

The nozzle body 10 comprises one or more injection channels 20 for dispensing fuel from the cavity 15. In FIG. 1, two injection channels 20 are shown. The nozzle body 10 may have more than two injection channels 20. For example, the injection channels 20 may be distributed and/or evenly distributed on an imaginary circular contour in top view along a longitudinal axis L of the nozzle body 10.

In the cavity 15, a valve needle 5 is received. The valve needle 5 is axially movable with respect to the nozzle body 10 in reciprocating fashion. The valve needle has a sealing body 7 at its end facing towards the fuel outlet end 12. The sealing body 7 is in contact with a valve seat 3 of the nozzle body 10 in a closing position of the valve needle 5 to prevent fluid flow through the injection channels 20. The valve needle 5 is longitudinally displaceable away from the valve seat 3 by an actuator assembly (not shown in the figures) of the fuel injection valve 1 so that the sealing body 7 is spaced apart from the valve seat 3 for releasing fluid flow through the injection channels 20.

Figure 2:
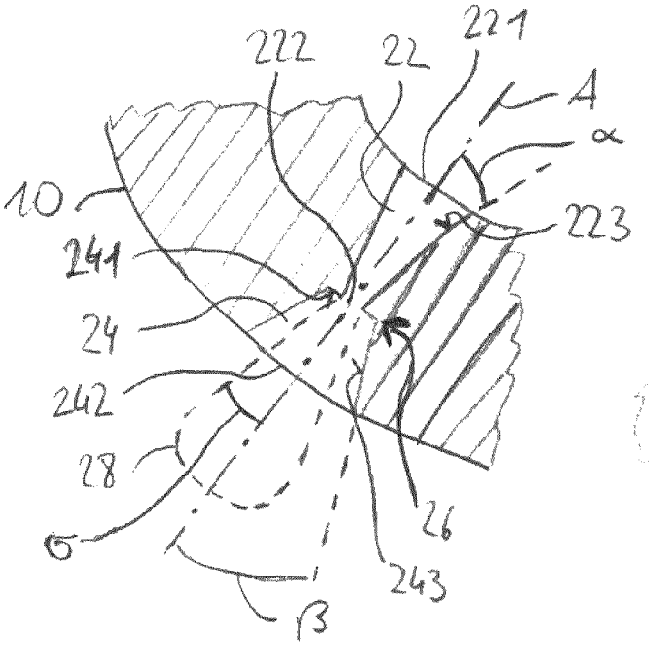
FIG. 2 shows an injection channel of the nozzle body of FIG. 1 in an enlarged view.
Figure 3:
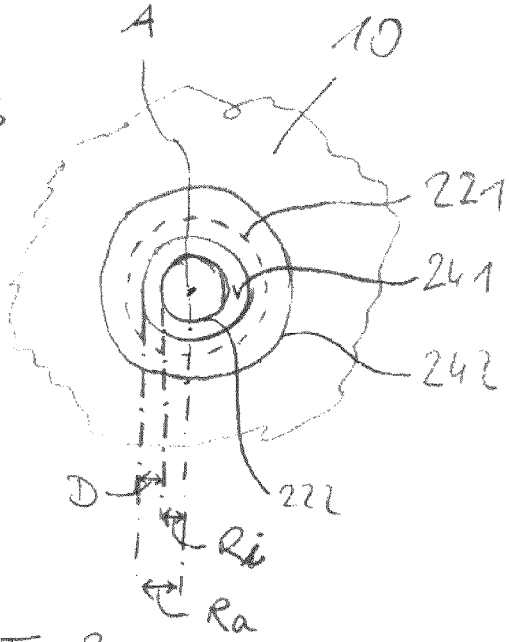
FIG. 3 shows a top view of the injection channel of FIG. 2.

FIG. 2 shows an enlarged view of one of the injection channels 20 of the nozzle body 10. FIG. 3 shows a top view of the injection channel 20 along a channel axis A of the injection channel 20 from the outside of the nozzle body 10.

The injection channel 20 has a first section 22 and a second section 24, downstream the first section 22, the first and second sections having a common interface 26. More specifically, the first and second sections 22, 24 are arranged subsequent to one another along a common channel axis A and adjoin one another at the common interface 26. The first section 22 extends from a fuel inlet opening 221 to a second opening 222 which is comprised by the common interface 26. The second section 24 extends from a bottom surface 241 to a fuel outlet opening 242. The bottom surface 241 of the second section 24 of the injection channel 20 is comprised by the common interface 26 and is perforated by the second opening 222.

The outer contour of the second opening 222 is defined by a sharp edge which is formed at the interface of the circumferential side surface 223 of the first section 22 and the bottom surface 241. The sharp edge constitutes a breakaway edge where the fluid flow separates from the surface of the injection channel 20. The sharp edge is in particular understood to include an angle of more than 270° between the side surface 223 of the first section 22 and the bottom surface 241.

The cross-sectional area of the first section 22 is monotonically decreasing in the course along the channel axis A from the fuel inlet opening 221 to the second opening 222. In the case of the injection channel 20 shown in FIG. 2, the first section 22 is in the shape of a truncated cone which is rotationally symmetric with respect to the channel axis A.

In some embodiments, the fuel flow may separate from the wall of the cavity 15 upon entering the injection channel 20 through the fuel inlet opening 221. The convergent shape of the first section 22 promotes re-attachment of the fuel flow to the side surface 223 of the first section 22. By means of the convergent shape of the first section 22, a particularly small axial velocity of the fuel and, thus, a small penetration depth of the fuel into the combustion chamber is achievable.

In some embodiments, roughly exemplified by the injection channel on the right-hand side of FIG. 1, the contour of the side surface 223 of the first section 22 can be curved. For example, side surface 223 may be represented by a rotationally symmetric shape resulting from rotating a curved line around the channel axis A. For example, the side surface 223 may be in the shape of a hyperboloid.

In some embodiments (not shown in the figures), the side surface 223 may have a cylindrical or conical basic shape and a rounded edge at the fuel inlet opening 221. In this way, the risk of separation of the fuel flow from the surface of the cavity 15 when the fuel enters the injection channel 20 at the fuel inlet opening 221 is particularly small.

The cross-sectional area of the second section 24 is monotonically increasing in the course along the channel axis A from the bottom surface 241 to the fuel outlet opening 242. In the embodiment of FIG. 2, the second section is in the shape of a truncated cone which is rotationally symmetric with respect to the channel axis A.

The side surface 223 of the first section 22 of the injection channel 20 according to the exemplary embodiment of FIG. 2 has an inclination angle $\beta$between 0.3° and 6° with respect to the channel axis A, the channel axis A being at the same time the central axis of the truncated cone shape of the first section 22. In the present embodiment, the inclination angle $\alpha$ has a value of 1.4°.

In this way, when the sealing element 7 is moved out of contact with the valve seat 3 for dispensing gasoline through the injection channels 20, the first section 22 shapes a divergent fuel spray cone 28 (roughly indicated by the dashed line in FIG. 2). The fuel spray cone 28 emerges from the second opening 222 with a predetermined cone angle $\sigma$. The cone angle $\sigma$ is the inclination angle of an imaginary circumferential envelope surface of the cone with respect to a central axis of the spray cone 28. The central axis of the spray cone is identical to the channel axis A in the present embodiment. In one embodiment, the cone angle $\sigma$ is equal to the inclination angle $\alpha$.

The second section 24 has a circumferential side surface 243 having an inclination angle $\beta$, which is at least as large as the cone angle $\sigma$ of the spray cone 28 and at most 6° larger than said cone angle $\sigma$ with respect to the channel axis A. The channel axis A is also the central axis of the truncated cone shape of the second section 24 in the present embodiment.

The first section 22, the second section 24 and the spray cone 28 are preferably rotationally symmetric with respect to the channel axis A. In this way, a good cleaning of the side surface 243 of the second section 24 is achievable in all angular regions of the side surface 243 around the channel axis A.

In some embodiments, the distance between the fuel inlet opening 221 and the second opening 222 has a value of 1.1 times the diameter of the fuel inlet opening 221. In other embodiments, the ratio of the distance between the fuel inlet opening 221 and the common interface 26 to the diameter of the fuel inlet opening 221 has a value between 1 and 2, preferably between 1 and 1.5, the limits being included in each case.

The bottom surface 241 of the second section 24 extends circumferentially around the second opening 222 of the first section 22. In some embodiments, the bottom surface 241 is in the shape of a circular ring having an inner contour defined by the second opening 222 and an outer contour defined by an interface between the bottom surface 241 and the side surface 243 of the second section 24. The radius Ra of the outer contour is larger than the radius Ri of the inner contour by 50 μm or less. In some embodiments, it is 5 μm or larger. In other words, a distance D from the second opening 222 to the side surface 243 of the second section 24 at its interface with the bottom surface 241 is 50 μm or less, and also 5 μm or more.

The invention is not limited to specific embodiments by the description on basis of these exemplary embodiments. Rather, it comprises any combination of elements of different embodiments. Moreover, the invention comprises any combination of claims and any combination of features disclosed by the claims.

What is claimed is:

1. A nozzle body for a fuel injection valve, the nozzle body comprising:

a cavity; and an injection channel for dispensing fuel from the cavity, the injection channel including a first section, a second section downstream of the first section, and a central axis; and a common interface disposed in a single plane perpendicular to the central axis between the first section and the second section;

the first section extending from a fuel inlet opening to a second opening disposed at the common interface, the first section being tapered by a first section taper angle and having a cross-sectional area that monotonically decreases from the fuel inlet opening to the second opening in the common interface, the second section extending from the second opening and an annular bottom surface disposed at the common interface to a fuel outlet opening, wherein the annular bottom surface extends perpendicular to the central axis and surrounds the second opening, wherein the second opening is centered in the annular bottom surface, and wherein a radius of the annular bottom surface is greater than a radius of the second opening, and the second section being tapered by a second section taper angle and having a cross-sectional area of the second section monotonically increasing from the common interface to the fuel outlet opening, the second section taper angle being at least as large as an opening angle of a spray cone determined by a spray of fuel exiting the first section through the second opening, wherein the spray cone is located fully within and spaced apart from an inner surface of the second section, and the opening angle of the spray cone is defined by the first section taper angle;

the first section includes a truncated cone tapering from the fuel inlet opening to the second opening; and the taper angle of the first section includes an inclination angle between 0.3° and 6°, inclusive, of a side surface of the first section with respect to a central axis of the truncated cone shape of the first section.

2. The nozzle body of claim 1, further comprising the second section shaped as a truncated cone widening from the bottom surface to the fuel outlet opening.

3. The nozzle body of claim 2, wherein the inclination angle is at least as large as said cone angle and at most 6° larger than said opening angle of the spray cone.

4. The nozzle body of claim 1, wherein an extent of the annular bottom surface of the second opening from a side surface of the second section is 50 μm or smaller.

5. A fuel injection valve comprising:

a cavity with a longitudinal axis;

an injection channel for dispensing fuel from the cavity; and a valve needle disposed in the cavity and axially movable along the longitudinal axis to prevent fluid flow through the injection channel in a closed position;

the injection channel including a first section, a second section downstream of the first section, and a central axis;

a common interface disposed in a single plane perpendicular to the central axis between the first section and the second section;

the first section extending from a fuel inlet opening to a second opening disposed at the common interface;

the first section being tapered by a first section taper angle and having a cross-sectional area that monotonically decreases from the fuel inlet opening to the second opening in the common interface;

the second section extending from the second opening and an annular bottom surface disposed at the common interface to a fuel outlet opening, wherein the annular bottom surface extends perpendicular to the central axis and surrounds the second opening, wherein the second opening is centered in the annular bottom surface, and wherein a radius of the annular bottom surface is greater than a radius of the second opening, and the second section being tapered by a second section taper angle and having a cross-sectional area of the second section monotonically increasing from the common interface to the fuel outlet opening, the second section taper angle being at least as large as an opening angle of a spray cone determined by a spray of fuel exiting the first section through the second opening, wherein the spray cone is located fully within and spaced apart from an inner surface of the second section, and the opening angle of the spray cone is defined by the first section taper angle;

the first section includes a truncated cone tapering from the fuel inlet opening to the second opening; and the taper angle of the first section includes an inclination angle between 0.3° and 6°, inclusive, of a side surface of the first section with respect to a central axis of the truncated cone shape of the first section.

6. A fuel injection valve according to claim 5, further comprising two or more injection channels.

7. A fuel injection valve according to claim 5, further comprising two or more injection channels distributed along a circular contour around the longitudinal axis.

8. A fuel injection valve according to claim 5, further comprising two or more injection channels distributed evenly along a circular contour around the longitudinal axis.

9. A fuel injection valve according to claim 5, further comprising the second section shaped as a truncated cone widening from the annular bottom surface to the fuel outlet opening.

10. A nozzle body for a fuel injection valve, the nozzle body comprising:

a cavity; and an injection channel for dispensing fuel from the cavity, the injection channel including a first section, a second section downstream of the first section, and a central axis; and a common interface disposed in a single plane perpendicular to the central axis between the first section and the second section;

the first section extending from a fuel inlet opening to a second opening disposed at the common interface, the first section being tapered by a first section taper angle and having a cross-sectional area that monotonically decreases from the fuel inlet opening to the second opening in the common interface, the second section extending from the second opening and an annular bottom surface disposed at the common interface to a fuel outlet opening, wherein the annular bottom surface extends perpendicular to the central axis and surrounds the second opening, wherein the second opening is centered in the annular bottom surface, and wherein a radius of the annular bottom surface is greater than a radius of the second opening, and the second section being tapered by a second section taper angle and having a cross-sectional area of the second section monotonically increasing from the common interface to the fuel outlet opening, the second section taper angle being at least as large as an opening angle of a spray cone determined by a spray of fuel exiting the first section through the second opening, wherein the spray cone is located fully within and spaced apart from an inner surface of the second section, and the opening angle of the spray cone is defined by the first section taper angle;

the second section includes a truncated cone widening from the bottom surface to the fuel outlet opening; and the inclination angle is at least as large as said cone angle and at most 6° larger than said opening angle of the spray cone.

* * * * *